US006521569B2

(12) United States Patent
Abramowski et al.

(10) Patent No.: US 6,521,569 B2
(45) Date of Patent: Feb. 18, 2003

(54) NON-FLAMMABLE LIQUID PENETRATING LUBRICANT

(75) Inventors: Horst Abramowski, Matthews, NC (US); James D. Wells, Indian Trail, NC (US)

(73) Assignee: Radiator Specialty Company, Charlotte, NC (US)

( * ) Notice: Subject to any disclaimer, the term of this patent is extended or adjusted under 35 U.S.C. 154(b) by 0 days.

(21) Appl. No.: 08/481,186

(22) Filed: Jun. 7, 1995

(65) Prior Publication Data

US 2003/0013618 A1 Jan. 16, 2003

Related U.S. Application Data

(63) Continuation of application No. 08/339,631, filed on Nov. 14, 1994, now abandoned, which is a continuation of application No. 08/034,786, filed on Mar. 19, 1993, now abandoned.

(51) Int. Cl.[7] ..... C10M 131/04
(52) U.S. Cl. ..... 508/181; 508/590
(58) Field of Search ..... 252/58; 508/181, 508/590

(56) References Cited

U.S. PATENT DOCUMENTS

| | | | | | |
|---|---|---|---|---|---|
| 3,314,889 | A | | 4/1967 | Christian | |
| 3,903,329 | A | * | 9/1975 | Kay et al. | 427/145 |
| 3,962,171 | A | * | 6/1976 | Robbins | 428/461 |
| 4,041,148 | A | * | 8/1977 | Simons et al. | 424/45 |
| 4,439,343 | A | * | 3/1984 | Albanese | 252/305 |
| 4,465,607 | A | | 8/1984 | Cottell | |
| 4,528,109 | A | | 7/1985 | Fifolt et al. | |
| 4,615,917 | A | * | 10/1986 | Runge | 252/58 |
| 4,737,300 | A | * | 4/1988 | Wirth et al. | 252/41 |
| 4,948,521 | A | * | 8/1990 | Stewart et al. | 252/28 |
| 4,985,161 | A | | 1/1991 | Tohzuka et al. | |
| 5,059,334 | A | | 10/1991 | Scheld | |
| 5,160,646 | A | | 11/1992 | Scheld | |
| 5,902,412 | A | * | 5/1999 | Taylor | 134/12 |

* cited by examiner

*Primary Examiner*—Cephia D. Toomer
(74) *Attorney, Agent, or Firm*—Alston & Bird LLP

(57) ABSTRACT

The present invention relates to a non-flammable, anti-corrosive, non-discoloring product which has both penetrating and lubricating characteristics and is prepared with a non-flammable propellant that does not emit volatile organic compounds, but does replace water, and to a process for producing the same.

27 Claims, No Drawings

NON-FLAMMABLE LIQUID PENETRATING LUBRICANT

This application is a continuation, of application Ser. No. 08/339,631, filed Nov. 14, 1994, which is a continuation of application Ser. No. 08/034,786, filed Mar. 19, 1993, both abandoned.

BACKGROUND OF THE INVENTION

1. Field of the Invention

The present invention relates to a non-flammable, anticorrosive, non-discoloring product which has both penetrating and lubricating characteristics and is prepared with a non-flammable propellant, and which also replaces water, and to a process for producing the same.

2. Related Prior Art

Lubricants are materials used to diminish friction between the moving surfaces; also to decrease friction between a cutting tool and the material being cut. A wide variety of materials is used for manufacturing lubricants. Animal lubricants are obtained from the fat of common animals and can be classified as hard fats (stearin) and soft fats (lard) or naturally occurring combinations. Vegetable lubricants include rape seed oil, cottonseed oil, soybean oil, castor oil, and linseed oil. They range in properties from solid to liquid. Petroleum and mineral oil lubricants, because of their greater stability, are usually preferred for machine applications. Lubricants range from light oils, to very heavy solid greases. Graphite, a solid, is also used as a lubricant.

Because of increased requirement for lubricants, including higher temperature and pressure applications, greater durability, and tolerance to wide changes in ambient temperature conditions, numerous, synthetic lubricants have been developed. These include synthetic hydrocarbons, carboxylic acid esters, silicones, polyethers (polyalkylene glycols), phosphate esters, silicate esters, highly fluorinated compounds, and polyaromatics (polyphenyls and polyphenyl ethers). In selecting a lubricant, the following characteristics are considered: (1) lubricity and antiwear properties; (2) fluid range; (3) viscosity index; (4) additive response of base oil; (5) oxidation stability; (6) thermal stability; (7) hydrolytic stability; (8) fire resistance; (9) compatibility with petroleum products; (10) compatibility with paints, plastics, and elastomers; and (11) cost. See Van Nostrand's Scientific Encyclopedia, 6th Ed., Douglas A M. Considine, P. E., Editori, Van Nostrand Reinhold Co., NY p. 1787–1788 (1983).

Lubricant sprays containing oil and polytetrafluoroethylene (PTFE) and processes for making them are known. Unfortunately, such lubricants are classified as hazardous according to various regulations, fire codes and building codes, such as the National Environmental Policy Act (NEPA).

Model fire codes which regulate flammable aerosols include National Fire Codes promulgated by the National Fire Protection Association (NFPA), Uniform Fire and Building Codes which apply to the western United States and are promulgated by the International Conference of Building Officials (ICBO), Standard Fire and Building Codes which apply to the southeastern United States and are promulgated by the Southern Building Code Congress International (SBCCI) and National Fire and Building Codes which apply to the northeastern United States and are promulgated by Building Officials and Code Administrators (BOCA).

The National Fire Code and the Uniform Fire Code classify aerosol products according to three classification levels. Section 30B of the National Fire Code defines Level 1 Aerosols as (1) non-water soluble aerosols containing a non-flammable propellant and less than 25 percent flammable constituents in the base product, (2) water soluble aerosols containing non-flammable propellant and less than 85 percent constituents in the base product or (3) aerosols containing less than 50 percent flammable propellant and less than 25 percent flammable constituents in the base product. Level 3 Aerosols are defined as (1) aerosols containing more than 80 percent flammable propellant and less than 25 percent flammable constituents in the base product, (2) water soluble aerosols containing greater than 50 percent flammable propellant and greater than 25 percent flammable constituents in the base product, (3) non-water soluble aerosols containing greater than 50 percent flammable propellant and from 25 to 55 percent flammable constituents in the base product, (4) non-water soluble aerosols containing non-flammable or less than 80 percent flammable propellants and greater than 55 percent flammable constituents in the base product or (5) water soluble or non-water soluble aerosols containing greater than 80 percent flammable propellant and less than 20 percent flammable constituents in the base product.

Uniform Fire Code Standard No. 88-1 defines Level 1 Aerosol products as (1) water soluble and non-water soluble aerosols containing non-flammable propellant and less than 25 percent flammable constituents in the base product or (2) aerosols containing less than 50 percent flammable propellant and less than 25 percent flammable constituents in the base product. Level 3 Aerosols are defined as (1) aerosols containing greater than 80 percent flammable propellant and less than 25 percent flammable constituents in the base product, (2) water soluble aerosols containing greater than 50 percent flammable propellant and greater than 25 percent flammable constituents in the base product, (3) non-water soluble aerosols containing non-flammable propellant and from 25 to 55 percent flammable constituents in the base product, (4) non-water soluble aerosols containing less than 50 percent flammable propellant and from 25 to 55 percent flammable constituents in the base product, (5) non-water soluble aerosols containing greater than 50 percent flammable propellant and 25 to 55 percent flammable constituents in the base product, (6) non-water soluble aerosols containing non-flammable or less than 80 percent flammable propellant and greater than 55 percent flammable constituents in the base product or (7) water soluble or non-water soluble aerosols containing greater than 80 percent flammable propellant and less than 20 percent flammable constituents in the base product. The Uniform Fire Code further provides that where a flammable product equals or exceeds 50 percent of the net weight of the container contents, the classification system shall be raised to the next higher level. Section 9-A of the Uniform Building Code governing hazardous materials, liquids and chemicals refers to the Uniform Fire Code for aerosol regulation.

Prior art lubricants have Level 3 Aerosol flammability, and therefore prevent certain hazards to the environment, facility, and to the person using the lubricant.

A separate body of prior art discloses various lubricants for treating rusted surfaces:

U.S. Pat. No. 5,059,334 to Scheld discloses a lubricant containing solid fluorocarbon particles (such as PTFE), oil, a lubricant carrier medium (for example, a phosphate ester such as tricresyl phosphate) and a chlorinated solvent (such as 1,1,1 trichloroethane).

U.S. Pat. No. 5,160,646 to Scheld discloses a sprayable lubricant containing solid fluorocarbon particles (such as polytetrafluoroethylene), a carrier medium (for example, a phosphate ester such as tricresyl phosphate), a buoyant medium (such as oil) and a chlorinated solvent vehicle (such as 1,1,1 trichloroethane).

U.S. Pat. No. 3,314,889 to Christian describes a grease composition containing a high-temperature organosilicon lubricating base fluid and a fluoroethylene polymer.

U.S. Pat. No. 4,528,109 to Fifolt et al. discloses non-flammable hydraulic fluids containing fluorinated chlorotrifluoroethylene oil (the non-flammable component), an aliphatic ester, a liquid polyester or polyether, a hydrocarbon oil having a low wax content and a phenolic antioxidant.

U.S. Pat. No. 4,465,607 to Cottell describes a lubricating composition containing a lubricating oil having particles of polytetrafluoroethylene uniformly dispersed and suspended therein.

U.S. Pat. No. 4,985,161 to Tohznka et al. involves a fluorine-containing grease comprising a perfluoroalkyl polyether and polytetrafluoroethylene.

The flammability of prior art lubricants present distinct hazards during use. Further, known solid lubricants, such as graphite and molybdenum, have the disadvantage of discoloring or staining clothing and surfaces to which they are applied. Therefore, it is desirable to provide a non-flammable, anti-corrosive, non-discoloring penetrating lubricant prepared with a non-flammable propellant which replaces water.

SUMMARY OF THE INVENTION

Applicants have unexpectedly discovered a non-flammable liquid surface-penetrating lubricant which comprises:

a natural or synthetic oil; a fluorocarbon polymer; and a chlorinated solvent.

In a preferred aspect of the invention, a non-flammable liquid surface-penetrating lubricant is provided, which comprises:

a mineral oil; a fluorocarbon polymer selected from the group consisting of tetrafluoroethylene, chlorotrifluoroethylene and polymers thereof, polytetrafluoroethylene, tetrafluoroethylene homopolymer, polytetrafluoroethylene resin, fully fluorinated copolymers of hexafluoropropene and tetrafluoroethylene, fluorinated ethylene-propylene polymers, polyvinylidene fluoride, hexafluoropropylene, fluoroelastomers and mixtures thereof; and a non-flammable solvent selected from the group consisting of perchloroethylene, methyl chloroform and dichloroethyl ethers.

The invention also contemplates a method of producing a non-flammable liquid surface-penetrating lubricant, which comprises:

mixing oil with a fluorocarbon polymer;

adding a non-flammable solvent to the mixture; and blending the mixture until the lubricant formulation is prepared.

DESCRIPTION OF THE PREFERRED EMBODIMENTS

The present invention provides a non-flammable liquid surface-penetrating lubricant, which comprises:

oil; fluorocarbon polymer; and a non-flammable solvent.

The invention also contemplates a method of producing a non-flammable surface-penetrating lubricant-penetrant, which comprises:

mixing oil with a fluorocarbon polymer; adding a non-flammable solvent to the mixture; and blending the mixture.

Applicants have unexpectedly found that the combination of a natural or synthetic oil, a fluorocarbon polymer, and a non-flammable, chlorinated solvent unexpectedly produces a Level 1 Aerosol lubricant-penetrant which is non-flammable, does not emit harmful and has a low surface tension. The oil and fluorocarbon polymer provide lubrication, and the non-VOC chlorinated solvent lowers the surface penetrant tension and provides the mixture with the desired non-flammable characteristics.

The oil used in connection with the novel products and process of this invention comprises from about 1 to about 45 percent by weight of the non-flammable surface-penetrating lubricant. Preferably, the oil comprises from about 1 to about 28 percent of the lubricant-penetrant, and most preferably the oil comprises from about 4 to about 20 percent of the lubricant-penetrant. Further, the preferred oil employed in the invention is a non-VOC oil by California Air Resources Board standards, which controls and limits VOCs containing less than 13 carbon chains.

The term "oil" as used.herein refers to both natural and synthetic oils. Natural oils useful in the inventive formulations include, but are not limited to: vegetable oil (for example, linseed, tung, oiticica, soybean, cottonseed, castor, coconut, palm) and animal oil (for example fish oils, fishliver oils, oleic acid, sperm oil). Synthetic oils useful in the inventive method include, but are not limited to, petroleum based oils, such as mineral oil, including petroleum (aliphatic or wax-base, aromatic or asphalt-base, and mixed-base) and petroleum-derived oil, chlorotrifluoroethylene-derived oils and fluorinated chlorotrifluoroethylene oil.

Fluorocarbon polymer used in the formulations of this invention is preferably present in amounts from about 0.05 to about 5 percent by weight of the non-flammable surface-penetrating lubricant and has been found to provide the unexpected results of the invention when combined with oil and a non-flammable solvent. Preferably, the fluorocarbon polymer comprises from about 0.5 to about 4 percent of the lubricant-penetrant, and most preferably the fluorocarbon polymer comprises from about 1.1 to about 1.8 percent of the lubricant-penetrant. The fluorocarbon polymer used preferably belongs to the class consisting of polytetrafluoroethylene (fully fluorinated copolymers of hexafluoropropene and tetrafluoroethylene), including tetrafluoroethylene and chlorotrifluoroethylene, typically designated by the trademark "Teflon" which is the property of E.I. Du Pont De Nemours & Co. of Wilmington, Del.

The term "fluorocarbon polymer" typically refers to members of the chain system $(—CF_2—CF_2—)_n$, which form highly unreactive substances. The term includes, but is not limited to, tetrafluoroethylene, chlorotrifluoroethylene and polymers thereof, polytetrafluoroethylene, tetrafluoroethylene homopolymer, polytetrafluoroethylene resin, fully fluorinated copolymers of hexafluoropropene and tetrafluoroethylene, fluorinated ethylene-propylene polymers, polyvinylidene fluoride, hexafluoropropylene, fluoroelastomers and mixtures thereof.

The non-flammable non-VOC solvent used in the inventive lubricant-penetrant compositions of this invention comprises from about 50 to about 98.5 percent by weight of the lubricant-penetrant. Preferably, the solvent comprises from about 54 to about 90 percent of the lubricant-penetrant, and most preferably the solvent comprises from about 30 to about 85 percent of the lubricant-penetrant. In a preferred embodiment, the non-flammable solvent is a chlorinated solvent, such as perchloroethylene, methyl chloroform or dichloroethyl ethers. The solvent provides non-flammability and lowers the surface penetrant tension of the inventive lubricant-penetrant.

The term "chlorinated solvent" includes chlorine-containing liquids which dissolve another compound to form a homogeneous liquid mixture in one phase, such as perchloroethylene, methyl chloroform and dichloroethyl ethers.

The term "perchloroethylene" as used herein refers to tetrachloroethylene, also known as ethylene tetrachloride or tetrachlorethylene, and includes solvents designated by various trade names. The term "methyl chloroform" as used herein refers to 1,1,1-trichloroethane, also known as chlorothene, and similar solvents. The term "dichloroethyl ethers" as used herein refers to symdichloroethyl ether, also knows as 1,1'-Oxybis[2-chloroethane], bis(2-chloroethyl) ether or β,β'-dichloroethyl ether, and similar solvents.

The inventive lubricant-penetrant compositions may be applied to mechanical parts needing lubrication at room temperature. An article may be treated by applying the inventive lubricant-penetrant to the article's surface by spraying, dipping, painting, rubbing or any other conventional means. Preferably, the surface to be treated is cleaned and the inventive lubricant-penetrant is sprayed onto the surface in full strength to break loose nuts and bolts and to stop squeaks.

The invention also contemplates an embodiment wherein the lubricant-penetrant contains additional additives. One additive can be gaseous in nature and may include from about 0.5 to about 5 percent by weight carbon dioxide, which is used instead of prior art VOC-flammable propellants to propel the inventive product and establish a spray pattern during spray-on application. Most preferably, the inventive lubricant-penetrant contains from about 1.5 to about 3.5 percent carbon dioxide.

In an alternate embodiment of the invention, nitrogen gas or nitrous oxide gas could be substituted for carbon dioxide as the non-flammable propellant. Also, if chlorofluorocarbons, such as dichloro-difluoromethane, were deregulated, they could be substituted for carbon dioxide. Other gases which could be employed as a propellant in the invention include hydrocarbon fluorocarbons, such as tetrafluoroethane (134a) and difluorochloromethane (22), compressed air and other condensed or compressed gases having physical properties which render the gases suitable for being used as aerosol propellants.

The lubricant-penetrant may also contain from about 0.1 to about 7 percent by weight anti-corrosive agent, most preferably from about 0.5 to about 5.5 percent. Further, the inventive lubricant-penetrant may include from about 0.01 to about 2 percent by weight perfume or fragrance. The lubricant-penetrant most preferably includes from about 0.1 to about 0.5 percent perfume or fragrance.

The term "anti-corrosive agent" as used herein refers to corrosion inhibitors, including but not limited to: sodium nitrate-borax and organic inhibitors, nonylphenoxyacetic acid, phosphoric acid-type metal conditioners and rust removers, film formers, barium and calcium compounds and similar corrosion inhibitors.

The term "perfume or fragrance" as used herein refers to fragrant substances resembling a natural, odiferous substance in odor. Such a perfume or fragrance may be (1) natural, if obtained by extraction of flower, herb, blossom, or plant; (2) artificial, if a mixture of natural oils or oil constituents; or (3) synthetic, if a mixture of synthetically produced substances (See Grant & Hackh's Chemical Dictionary, 5th Ed., Roger Grant and Claire Grant, Editors, McGraw-Hill Book Co., NY, page 432 (1987).

The invention is further illustrated by the following examples. All percentages used throughout the specification and claims are based on weight of the final product, unless otherwise indicated, and all formulations total 100% by weight.

EXAMPLE 1

Method of Making a Non-Flammable Lubricant-Penetrant

The inventive lubricant-penetrant can be prepared according to the following procedure.

Oil and PTFE particles are blended with a standard dispersion mixer, such as a homogenizer, at room temperature. Perchloroethylene is then added at room temperature (22° C.) and blended into the mixture, resulting in a stable dispersion particularly useful as a lubricant-penetrant.

A sample formula would be as follows:

| | | Parts by Weight in Oil Component |
|---|---|---|
| oil | 21.5 grams | 23.4 |
| PTFE | 0.1 grams | 0.1 |
| perchloroethylene | 70.41 grams | 76.5 |

EXAMPLE 2

Method of Making Non-Flammable Lubricant-Penetrant

The inventive lubricant-penetrant can also be prepared according to the following experiment.

Oil and PTFE particles are blended at high speed with a standard dispersion mixer, such as a homogenizer, at room temperature. Perchloroethylene, anti-corrosive agent and fragrance are then added to the mixture at room temperature (22° C.). and the mixture was blended until uniform in consistency, resulting in a stable dispersion particularly useful as a lubricant-penetrant. Carbon dioxide is then added to the formulation in a dispenser container.

A sample formula would be as follows:

| | | Parts by Weight in Oil Component |
|---|---|---|
| oil | 67.0 grams | 22.4 |
| PTFE | 0.3 grams | 0.1 |
| perchloroethylene | 219.0 grams | 73.3 |
| carbon dioxide | 9.0 grams | 3.0 |
| anti-corrosive agent | 2.3 grams | 0.8 |
| perfume | 1.2 grams | 0.4 |

The invention being thus described, it will be obvious that the same may be varied in many ways. Such variations are not to be regarded as a departure from the spirit and scope of the invention, and also such modifications are intended to be included within the scope of the following claims.

We claim:

1. A non-flammable liquid surface-penetrating lubricant, consisting of:

(a) a natural or synthetic oil in an amount of up to about 28% by weight of said lubricant;

(b) a fluorocarbon polymer in an amount of up to about 1.8% of said lubricant;

(c) tetrachloroethylene; and (d) optionally one or more additives selected from the group consisting of anti-corrosive agents, perfumes and fragrances;

said lubricant being contained in a dispenser container and including a non-flammable aerosol propellant;

whereby said lubricant packaged in said container meets non-flammability requirements specifying that an aerosol product contain less than 50% flammable propellant and less than 25% flammable constituents in the base product.

2. A non-flammable liquid surface-penetrating lubricant, consisting of:

(a) a natural or synthetic oil in an amount of a least 1% by weight and up to about 28% by weight of said lubricant;

(b) a fluorocarbon polymer in an amount of up to about 1.8% of said lubricant;

(c) tetrachloroethylene; and (d) optionally one or more additives selected from the group consisting of anti-corrosive agents, perfumes and fragrances;

said lubricant being contained in a dispenser container and including a non-flammable aerosol propellant;

whereby said lubricant packaged in said container meets non-flammability requirements specifying that an aerosol product contain less than 50% flammable propellant and less than 25% flammable constituents in the base product.

3. The non-flammable liquid surface-penetrating lubricant of claim 2, wherein said natural or synthetic oil comprises from at least 4 to about 20% by weight of said lubricant.

4. The non-flammable liquid surface-penetrating lubricant or claim 2, wherein said oil is a mineral oil.

5. The non-flammable liquid surface-penetrating lubricant of claim 2, wherein said tetrachloroethylene comprises from about 50 to about 98.5% by weight of said lubricant.

6. The non-flammable liquid surface-penetrating lubricant of claim 2, wherein said tetrachloroethylene comprises from about 54 to about 90% by weight of said lubricant.

7. The non-flammable liquid surface-penetrating lubricant of claim 2, wherein said tetrachloroethylene comprises from about 30 to about 85% by weight of said lubricant.

8. The non-flammable liquid surface-penetrating lubricant of claim 2, which further consists from about 0.01 to about 2% by weight perfume or fragrance.

9. The non-flammable liquid surface-penetrating lubricant of claim 2, which further consists from about 0.1 to about 0.5% by weight perfume or fragrance.

10. The non-flammable liquid surface-penetrating lubricant of claim 2, wherein said non-flammable propellant is selected from the group consisting of carbon dioxide, nitrogen, nitrous oxide, chlorofluorocarbons, hydrocarbon fluorocarbons and compressed air.

11. The non-flammable liquid surface-penetrating lubricant of claim 2, wherein said fluorocarbon polymer comprises at least about 0.05% by weight of said lubricant.

12. A non-flammable liquid surface-penetrating lubricant, consisting of:

(a) a natural or synthetic oil in an amount of up to about 28% by weight of said lubricant;

(b) a fluorocarbon polymer in an amount of at least about 0.05% by weight and up to about 1.8% of said lubricant;

(c) tetrachloroethylene; and (d) optionally one or more additives selected from the group consisting of anti-corrosive agents, perfumes and fragrances;

said lubricant being contained in a dispenser container and including a non-flammable aerosol propellant;

whereby said lubricant packaged in said container meets non-flammability requirements specifying that an aerosol product contain less than 50% flammable propellant and less than 25% flammable constituents in the base product.

13. The non-flammable liquid surface-penetrating lubricant of claim 12, wherein said fluorocarbon polymer comprises at least about 1.1% by weight of said lubricant.

14. The non-flammable liquid surface-penetrating lubricant of claim 12, wherein said fluorocarbon polymer comprises fluoroethylene polymer.

15. The non-flammable non-VOC liquid surface-penetrating lubricant of claim 14, wherein said fluoroethylene polymer is selected from the group consisting of polytetrafluoroethylene, polychlorotrifluoroethylene and, polytetrafluoroethylene, tetrafluoroethylene homopolymer, polytetrafluoroethylene resin, fully fluorinated copolymers of hexafluoropropene and tetrafluoroethylene, fluorinated ethylene-propylene polymers, polyvinylidene fluoride, polyhexafluoropropylene fluoroelastomers and mixtures thereof.

16. A non-flammable liquid surface-penetrating lubricant, consisting of:

(a) a natural or synthetic oil in an amount of up to about 28% by weight of said lubricant;

(b) a fluorocarbon polymer in an amount of up to about 1.8% of said lubricant;

(c) tetrachloroethylene; and (d) optionally one or more additives selected from the group consisting of anti-corrosive agents, perfumes and fragrances;

said lubricant being contained in a dispenser container and including a non-flammable aerosol propellant, said non-flammable propellant comprising from about 0.5 to about 5% by weight carbon dioxide, based on the weight of said lubricant;

whereby said lubricant packaged in said container meets non-flammability requirements specifying that an aerosol product contain less than 50% flammable propellant and less than 25% flammable constituents in the base product.

17. The non-flammable liquid surface-penetrating lubricant of claim 16, wherein said non-flammable propellant comprises from about 1.5 to about 3.5% to by weight carbon dioxide, based on the weight of said lubricant.

18. A non-flammable liquid surface-penetrating lubricant, consisting of:

(a) a natural or synthetic oil in an amount of up to about 28% by weight of said lubricant;

(b) a fluorocarbon polymer in an amount of up to about 1.8% of said lubricant;

(c) tetrachloroethylene;

(d) from about 1 to about 7% by weight of an anti-corrosive agent; and (e) optionally one or more additives selected from the group consisting of perfumes and fragrances;

said lubricant being contained in a dispenser container and including a non-flammable aerosol propellant;

whereby said lubricant packaged in said container meets non-flammability requirements specifying that an aerosol product contain less than 50% flammable propellant and less than 25% flammable constituents in the base product.

19. The non-flammable liquid surface-penetrating lubricant of claim 18, which further consists from about 3 to about 5.5% by weight anti-corrosive agent.

20. A process for producing a non-flammable liquid surface-penetrating lubricant, consisting of:

(a) mixing up to about 28 parts per hundred parts of a natural or synthetic oil with up to 1.8 parts per 100 parts of a fluorocarbon polymer;

(b) adding tetrachloroethylene and optionally one or more additives selected from the group consisting of anti-corrosive agents, perfumes and fragrances to the mixture;

(c) blending the mixture, to prepare the non-flammable liquid surface-penetrating lubricant, wherein said oil comprises at least 1% by weight of said lubricant; and (d) packaging said lubricant in a container and adding a non-flammable propellant thereto.

21. The process of claim 20 wherein said oil is a mineral oil.

22. The process of claim 20 wherein said fluorocarbon polymer comprises at least 0.05% by weight of said lubricant.

23. The process of claim 22 wherein said fluorocarbon polymer is selected from the group consisting of polytetrafluoroethylene, polychlorotrifluoroethylene and polymers thereof, polytetrafluoroethylene, tetrafluoroethylene homopolymer, polytetrafluoroethylene resin, fully fluorinated copolymers of hexafluoropropene and tetrafluoroethylene, fluorinated ethylene-propylene polymers, polyvinylidene fluoride, polyhexafluoropropylene fluoroelastomers and mixtures thereof.

24. The process of claim 20 wherein said non-flammable solvent comprises from about 50 to about 98.5% by weight of said lubricant.

25. The process of claim 20 wherein step (d) further comprises adding from about 0.5 to about 5% by weight carbon dioxide to the mixture.

26. The process of claim 20 wherein step (b) further comprises adding from about 1 to about 7% by weight anti-corrosive agent to the mixture.

27. The process of claim 20 wherein step (b) further comprises adding from about 0.01 to about 2% by weight perfume or fragrance.

* * * * *

Disclaimer 6,521,569 — Horst Abramowski, Matthews, NC, (US); James D. Wells, Indian Trail, NC, (US.) NON-FLAMMABLE LIQUID PENETRATING LUBRICANT. Patent dated Feb. 18, 2003. Disclaimer filed Jul. 15, 2003, by the assignee, Alston & Bird.

Hereby enters this disclaimer to claim 1 of said patent.

*(Official Gazette, August 10, 2004)*

UNITED STATES PATENT AND TRADEMARK OFFICE

CERTIFICATE OF CORRECTION

PATENT NO. : 6,521,569 B2
DATED : February 18, 2003
INVENTOR(S) : Abramowski et al.

It is certified that error appears in the above-identified patent and that said Letters Patent is hereby corrected as shown below:

Title page,
Insert Item -- [*] Notice: This patent issued on a continued prosecution application filed under 37 CFR 1.53(d), and is subject to the twenty year patent term provisions of 35 U.S.C. 1.54(a)(2). --.

Column 7,
Line 13, "a" should read -- at --.
Lines 44 and 47, after "consists" insert -- of --.

Column 8,
Line 17, cancel "and".
Line 66, after "consists" insert -- of --.

Column 10,
Lines 1-2, cancel "and polymers thereof";
Line 6, after "polyhexafluoropropylene" insert a comma -- , --.

Signed and Sealed this

Twenty-second Day of March, 2005

JON W. DUDAS
*Director of the United States Patent and Trademark Office*